US008567653B2

(12) United States Patent
Wetsch et al.

(10) Patent No.: US 8,567,653 B2
(45) Date of Patent: Oct. 29, 2013

(54) AUTOMATED AIR PILLOW DISPENSER

(75) Inventors: Thomas D. Wetsch, St. Charles, IL (US); Thomas F. McNellis, Tinley Park, IL (US); Vitoldas Karaliukas, Oak Brook, IL (US)

(73) Assignee: Pregis Innovative Packaging, Inc., Deerfield, IL (US)

( * ) Notice: Subject to any disclaimer, the term of this patent is extended or adjusted under 35 U.S.C. 154(b) by 431 days.

(21) Appl. No.: 12/466,528

(22) Filed: May 15, 2009

(65) Prior Publication Data

US 2009/0302085 A1 Dec. 10, 2009

Related U.S. Application Data

(60) Provisional application No. 61/053,636, filed on May 15, 2008.

(51) Int. Cl.
*B65H 35/10* (2006.01)
*B26F 3/00* (2006.01)

(52) U.S. Cl.
USPC ..... 225/103; 83/835; 83/937

(58) Field of Classification Search
USPC ..... 225/3, 4, 5, 22, 29, 93, 95, 96.5, 97, 225/100, 103, 105, 2; 226/168–194; 30/356, 272.1, 353, 355, 357; 221/25; 83/835–855, 662, 698.91, 595, 341, 83/611, 614, 622, 694
See application file for complete search history.

(56) References Cited

U.S. PATENT DOCUMENTS 21,657 A * 10/1858 David ..... 83/622
2,920,342 A * 1/1960 Spang et al. ..... 83/369
3,269,870 A * 8/1966 Abramson ..... 29/623.1
3,660,189 A * 5/1972 Troy ..... 156/145
3,667,593 A 6/1972 Pendleton
3,675,542 A * 7/1972 Torigoe ..... 493/194
3,868,285 A * 2/1975 Troy ..... 156/147
4,017,351 A * 4/1977 Larson et al. ..... 156/494
4,462,526 A * 7/1984 Dumont et al. ..... 225/4

(Continued)

FOREIGN PATENT DOCUMENTS

EP 1 563 987 8/2005
GB 2 257 087 1/1993

OTHER PUBLICATIONS

English language International Search Report for International Application No. PCT/US2007/080248 filed Oct. 3, 2007.

*Primary Examiner* — Laura M Lee
(74) *Attorney, Agent, or Firm* — Dorsey & Whitney LLP

(57) ABSTRACT

A packaging material handling device is disclosed. The device includes a first pair of traction members configured for cooperatively engaging a chain of pre-inflated pillows from opposite sides thereof and being operable for driving the chain in the flow direction. The device further includes a second pair of traction members configured for cooperatively engaging the chain from opposite sides thereof. The second pair of traction members are spaced apart from the first pair of traction members along a flow direction and are operable for driving the chain in the flow direction. The first and second pairs of traction members are operable for holding the first and second portions of the chain during a breaking operation. The device further includes a breaking member disposed between the first and second pairs of traction members and movable against the chain across the flow direction in the breaking operation to break the chain for detaching the first portion from the second portion.

24 Claims, 11 Drawing Sheets

(56) References Cited

U.S. PATENT DOCUMENTS

| | | | | |
|---|---|---|---|---|
| 4,674,268 | A * | 6/1987 | Gavronsky et al. | 53/468 |
| 5,261,466 | A | 11/1993 | Koyanagi | |
| 6,497,066 | B1 * | 12/2002 | Harrison | 43/19 |
| 6,789,376 | B1 * | 9/2004 | Greenwood et al. | 53/468 |
| 6,932,134 | B2 | 8/2005 | Selle et al. | |
| 7,273,142 | B2 * | 9/2007 | Huis et al. | 198/369.2 |
| 8,240,533 | B2 * | 8/2012 | Wetsch | 225/93 |
| 2005/0160699 | A1 | 7/2005 | Perkins | |
| 2006/0010835 | A1 | 1/2006 | Shaw et al. | |
| 2006/0150788 | A1 * | 7/2006 | Kim | 83/13 |
| 2006/0251833 | A1 | 11/2006 | Gavin et al. | |
| 2006/0292320 | A1 | 12/2006 | Greenwood et al. | |
| 2008/0066852 | A1 | 3/2008 | Wetsch et al. | |
| 2009/0308965 | A1 * | 12/2009 | Piucci et al. | 242/526 |

* cited by examiner

AUTOMATED AIR PILLOW DISPENSER

FIELD OF THE INVENTION

The present invention relates to packaging materials and more particularly is directed to systems and methods used in the manufacturing and utilization of packaging pillows.

BACKGROUND OF THE INVENTION

Many techniques have been used to pack items for shipping and to absorb impacts on goods that are packed for shipping. Popular shipping protection methods includes the use of foam "peanuts," molded foam components, formed paper, and molded pulp packaging components.

A technique that has gained recent popularity involves the use of air-inflated cushions formed from a film material ("pillows"), such as disclosed in U.S. Pat. No. 6,932,134 and pending U.S. Patent Application Pub. Nos. 2006/0292320 and 2006/0251833. This style of packaging allows low-volume, uninflated pillow film materials to be shipped to packers, who then inflate the pillows as needed into shock-absorbing packing material. Pillow inflating machines can be used at the point of packaging to provide fully formed pillows at the time of packaging, thereby eliminating the need to store bulky packaging materials at the packaging site. The inflated pillows are formed in a continuous strip of individual pillows, and the desired length or number of the inflated pillows are separated from the continuous strip of inflated pillows as they are dispensed from the pillow inflating machine.

Air inflating machine systems may produce the air-inflated pillows at a rate that differs from the rate at which the actual packaging of goods is occurring. To accommodate the differences in the rate of pillow inflation and packaging use, the strip of formed packaging material is often fed into a holding bin adjacent to the inflation device. When packing material is needed by the packer, the end of the continuous strip of inflated pillows is withdrawn from the holding bin, an appropriate length of inflated pillows is measured by the packer, separated from the continuous strip and then placed into a shipping box to protect the packaged goods.

When a packer is using the pillows as packaging material, he must pull the required material out of the holding bin, typically using both hands to pull and place a number of pillows into the shipping box to fill any voids that may be present. When a sufficient number of pillows have been placed in the box to fill the voids, the packer must separate the pillows from the continuous strip of pillows. The need for the packer to reach into the holding bin and manually separate the required length or number of inflated pillows can be a time-consuming and laborious process, decreasing the overall efficiency of the packaging operation and thereby increasing costs. In some applications, a transfer stand may be placed in front of the holding bin with the end of the continuous strip of pillows draped over the transfer stand so that the packer does not have reach into the holding bin every time additional pillows are required. However, this still requires the packer to manually pull and tear the required number of pillows for packaging. A device is needed that can facilitate and improve the efficiency of dispensing air-inflated pillows to aid the packer in the packaging operation.

SUMMARY OF THE INVENTION

The present invention relates to a packaging material handling device. The preferred embodiment of the device includes a first pair of traction members configured for cooperatively engaging a chain of pre-inflated pillows from opposite sides thereof and being operable for driving the chain in the flow direction. The device further includes a second pair of traction members configured for cooperatively engaging the chain from opposite sides thereof. The second pair of traction members are spaced apart from the first pair of traction members along a flow direction and are operable for driving the chain in the flow direction. The first and second pairs of traction members are operable for holding the first and second portions of the chain during a breaking operation. The device further includes a breaking member disposed between the first and second pairs of traction members and movable against the chain across the flow direction in the breaking operation to break the chain for detaching the first portion from the second portion.

In a preferred embodiment, the breaking member is in the form of a blade including a substantially blunt leading edge. The leading edge can include a central lobe and a pair of outer lobes, the central lobe being disposed between the pair of outer lobes. Recessed areas can be disposed between the central lobe and the outer lobes, with a sloped surface extending from the central lobe into the recessed areas, such that the lobes contact the weakened area of the chain before the recessed area and the sloped surface gradually breaks the weakened area of the chain as the blade moves therethrough during the breaking operation.

In a further embodiment the packaging material handling device includes a first set of rollers configured for cooperatively engaging a chain of pre-inflated pillows from opposite sides thereof and being operable for driving the chain in the flow direction and a second set of rollers configured for cooperatively engaging the chain from opposite sides thereof. The second set of rollers can be spaced apart from the first set of rollers along a flow direction and can be operable for driving the chain in the flow direction. The first and second sets of rollers can be operable for holding the first and second portions of the chain during a breaking operation. At least some of the rollers, from at least one of the first and second sets of rollers, are preferably disposed on each side of the chain are staggered with respect to the rollers on the opposite side of the chain for engaging the chain at different lateral locations for deforming the chain.

BRIEF DESCRIPTION OF THE DRAWINGS

These and other objects, features and advantages of the invention will be apparent from a consideration of the following non-limiting detailed description considered in conjunction with the drawing figures, in which.

DETAILED DESCRIPTION OF THE PREFERRED EMBODIMENTS

Figure 1:
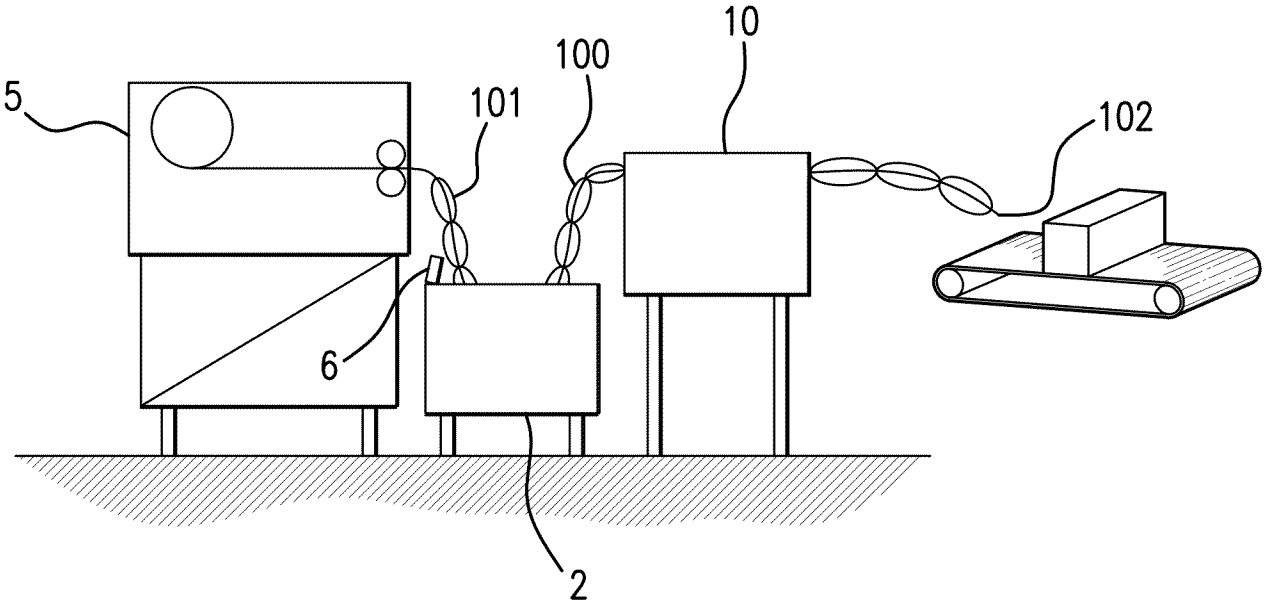
FIG. 1 is a side view of an automated transfer and dispensing apparatus in use alongside other components of an air inflated packaging pillow system.
Figure 2:
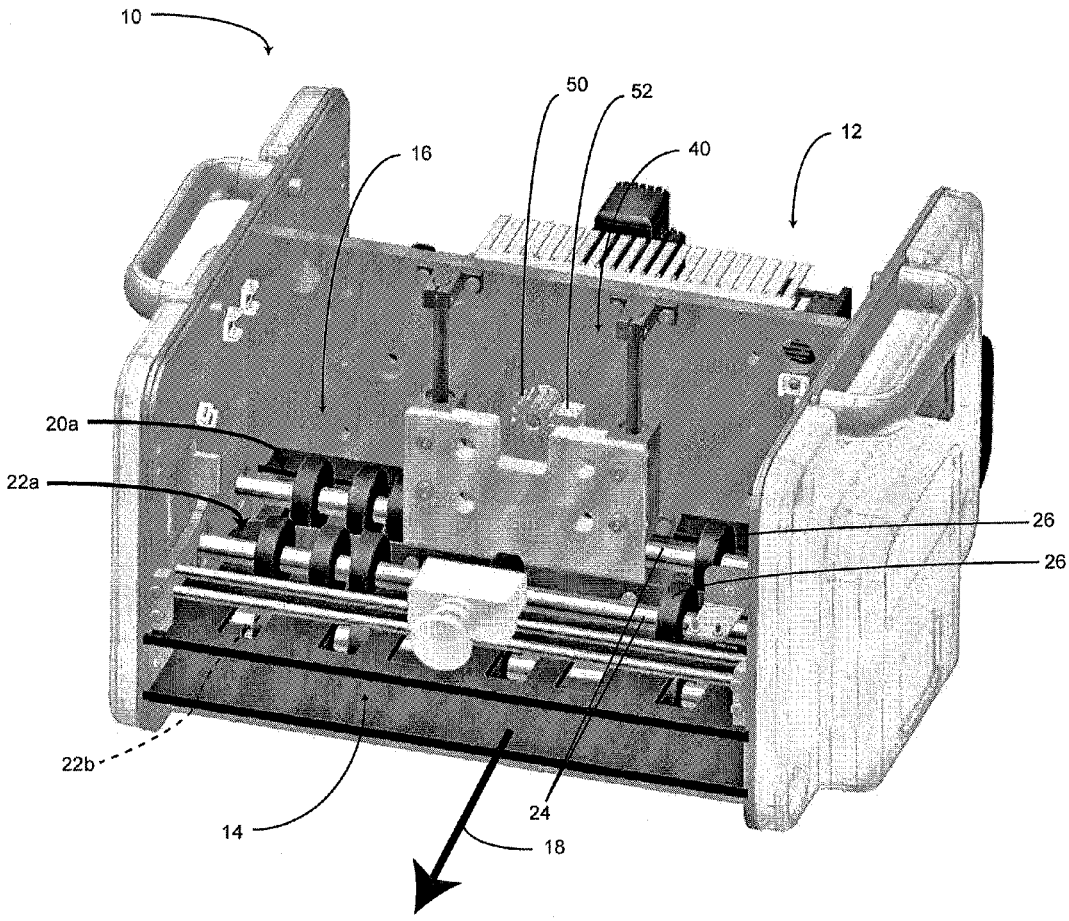
FIG. 2 is a perspective view of the automated transfer and dispensing apparatus of FIG. 1.

In FIG. 1, a preferred embodiment of the transfer and dispensing apparatus, which can be configured as an air-pillow burster or dispenser 10, is shown positioned adjacent to and above the location of a holding bin 2. The holding bin 2 may be used to collect void-fill or another type of packaging protective pillows 101 formed on a continuous chain 100 of adjacent pillows, as described, for example, in U.S. Patent Application Pub. No. 2006/0251833, the disclosure of which is incorporated by reference herein. As the pillows are inflated and sealed by a pillow inflation and sealing device 5, for example, as disclosed in U.S. Pat. No. 6,932,134, or U.S. Patent Application Pub. No. 2008/0066852, the disclosures of which are incorporated herein by reference. Preferably, the pillows filled with a fluid, and more preferably a gas, such as air. As inflated pillows 101 are formed by the pillow inflation and sealing device 5, they fall into the holding bin 2 in continuous chain 100. A sensor 6 associated with the holding bin 2, may be used to identify the amount of inflated pillows 101 that have accumulated in the holding bin 2 or when the holding bin 2 is filled to a predetermined level, and give appropriate instructions to control the manufacture of additional pillows, such as by interrupting the making of pillows 101 by the pillow manufacturing device 5.

Figure 9:
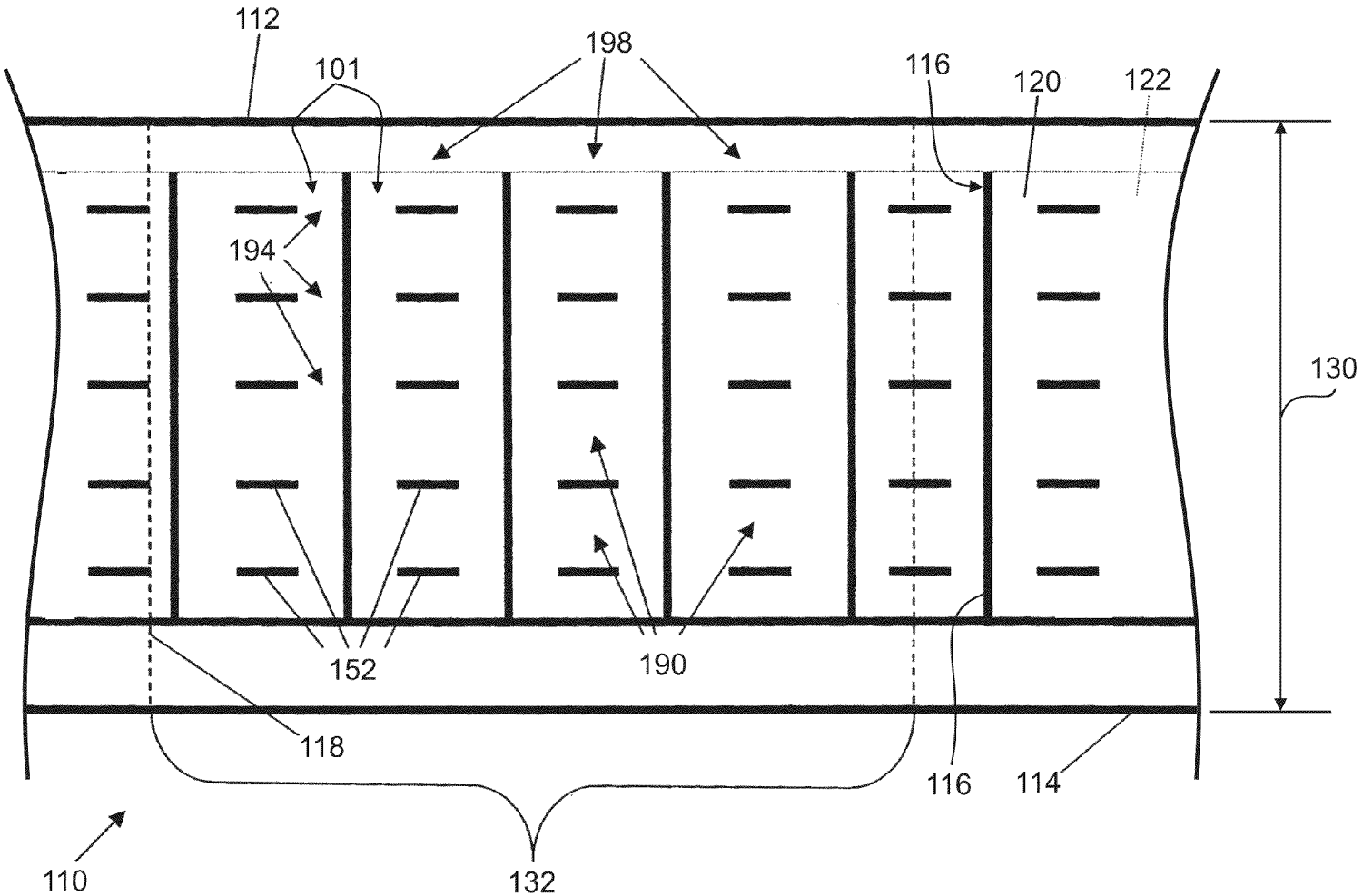
FIG. 9 is a top view of a film that can be used to form a chain of pre-filled packaging pillows for transfer and dispensing using the apparatus of FIG. 2.

FIG. 9, shows a typical web or strip 110 of uninflated material to be inflated and sealed into a series of pillows attached at perforated edges. The web 110 may be made of a variety of different materials, including materials such as polyethylene resins such as LDPE, LLDPE, HDPE; metallocenes; EVAs; and blends thereof. The web 110 has a top edge 112 and a bottom edge 114, both of which are closed. The web 110 includes generally transverse seals 116 and generally transverse perforations 618. The transverse seals 116 join a top sheet 120 of the web 110 to a bottom sheet 122 of the web 110 along the seals 116, while the transverse perforations 118 perforate the web through the top and bottom sheets 120 and 122. In a preferred embodiment of web 110, the perforations are formed within the transverse seals, which preferably have a width sufficient for the formation of the perforations. According to the embodiment shown, the transverse seals 116 begin at the bottom edge 114 of the web 110 and extend to a distance d from the top edge 112. The web 110 has a width 130, and a perforation-to-perforation length 132, which may be altered depending on the particular type of pillow to be manufactured. As further shown in FIG. 9, web 110 can include a plurality of longitudinal seal segments 152 that separate the individual pillows 101 into a plurality of polygonal sections 190 connected by at least one, but preferably two, oppositely-disposed channels 194 configured to permit air flow between sections 190.

While inflated pillows 101 continue to accumulate in the holding bin 2, the free end 102 of the continuous strip of inflated pillows 100 is drawn out of the holding bin 2 by the burster 10, which is preferably configured to dispense the free end 102 of pillows 101 to the operator when needed. The sensor 6 on the holding bin 2 can limit the transfer of inflated pillows 101 out of the holding bin 2 when supplies are low to prevent premature tearing of the continuous strip of pillows 100.

Burster 10 is shown in detail in FIGS. 2-5, and includes an inlet 12 and an outlet 14. A driving mechanism 16 is configured to move the continuous strip 101 of inflated pillows 100 through the burster 10 in a downstream direction 18 from inlet 12 and out from outlet 14. Driving mechanism 16 is further configured to hold the chain 100 in an appropriate position during a breaking operation. A breaking mechanism 40 is configured to carry out the breaking operation by moving braking member, which is preferably in the form of a blade 42, into contact with a selected perforation 118 and forcing braking member 42 through the perforation 118 to cause the perforation 118 to tear in order to form a strip segment of a desired number of pre-inflate pillows for use during a packing operation.

Driving mechanism 16 includes a first pair of oppositely-disposed traction elements 20*a*,20*b* and a second pair of oppositely-disposed traction elements 22*a*,22*b*. Each pair of traction elements 20*a*,20*b* and 22*a*,22*b* is configured to co-operatively grip the chain 100 of pre-inflated pillows 101 in order to move the chain 100 therethrough and to hold chain 100 during the breaking operation, both without tearing through one of the web layers 120,122 or creating too great a pressure within a pillow 101 resulting in popping thereof. The pairs of traction members 20*a*,22 and 22*a*,22*b* are further configured to move the chain 100 in a substantially straight path in downstream direction 18, such that the perforations 118 remain substantially aligned with breaking member 42 and such that chain 100 does not travel laterally within burster 10, which could result in chain 100 pushing up against a portion of the housing 11 of device 10 and could lead to jamming of burster 10 or damage to the chain 100.

Each pair of traction elements 20*a*,20*b* and 22*a*,22*b* consists of an upper element 20*a*,22*a* and a lower element 20*b*, 22*b*, wherein the upper element 20*a*,22*a* is disposed so as to contact the top of chain 100 as it passes therethrough, and wherein the lower element 20*b*,22*b* is disposed so as to contact the bottom of chain as it passes therethrough, the upper element 20*a*,22*a* being substantially vertically aligned with the corresponding lower element 20*b*,22*b*.

Referring to the second pair of traction elements 22*a*,22*b*, each traction element 22*a*,22*b* consists of an axle 24 rotatably affixed to housing 11 and extending perpendicularly to the flow direction 18 across the width of the interior of housing 11. Axle 24 has a plurality of rollers 26 affixed thereto that are configured to contact chain 100 so as to move chain 100 in the flow direction 18 and to hold chain 100 during the breaking operation. Rollers 26 can include an elastomeric outer surface to aid in gripping chain 100 form moving and holding thereof. In a preferred embodiment, rollers 26 are made from an elastomeric material such as carboxylated nitrile. By forming rollers 26 from an elastomeric material, rollers 26 can frictionally grip chain 100 without causing damage thereto. Further, some of the elastomeric rollers 26 can be biased against one another, such as a roller of the upper traction element 22*a* and a corresponding roller of the lower traction element 22*b*, causing deformation of the rollers 26, which allows for increased gripping pressure against a portion of chain 100.

Rollers 26 are preferably in the form of a cylinder having a diameter of between about 1.5 in. and about 3 in. In a preferred embodiment the diameter of rollers 26 is about 2 in. Rollers 26 preferably further have a width of between about ¼ in. and about ¾ in., and more preferably about ½ in. Rollers 26 also preferably include a fillet at the outside edges of the film-contacting surface thereof. The fillet preferably forms an angle of about 45° and extends into the film-contacting surface by between about 0.01 in and about 0.05 in, and more preferably about 0.03 in.

Figure 3A:
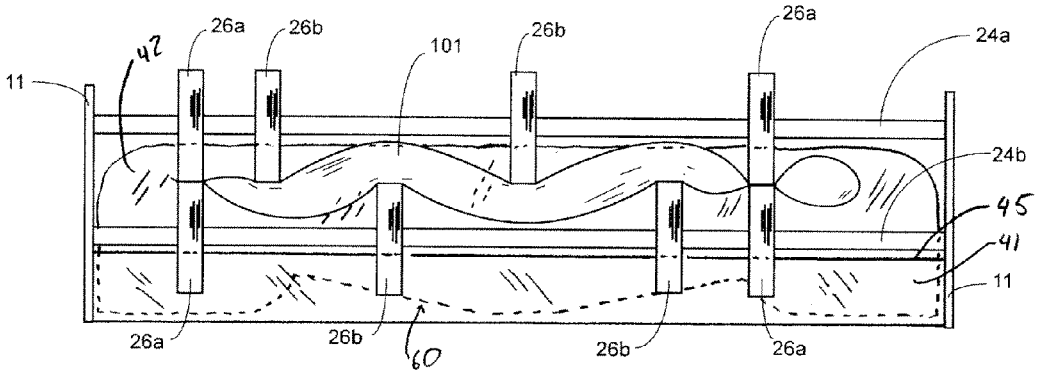
FIGS. 3A-3D are front views of the apparatus of FIG. 2 showing various configurations for traction elements used therein.
Figure 3B:
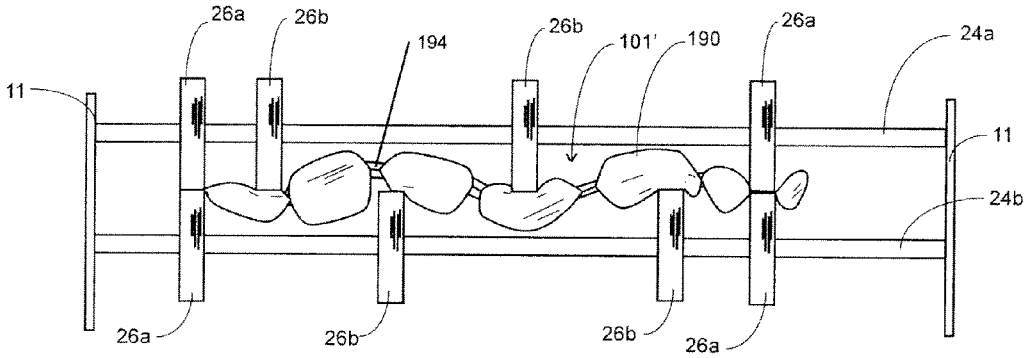

The number of rollers 26 included along each of axle 24*a* of upper traction element 22*a* and axle 24*b* of lower traction element 22*b* and the spacing between adjacent rollers on each axle 24*a*,24*b* can vary and can be selected to suitably grip a number of differently-configured chains of pre-inflated pillows. The various configurations of the chains include various chain lateral widths, various perforation-to perforation longitudinal lengths, varying pillow thicknesses and pillows having different sizes or geometries. An exemplary arrangement of rollers 26 for one pair of traction elements 22*a*,22*b* is shown in FIG. 3, wherein the outside rollers 26*a* are aligned in a vertical direction with a corresponding roller on the other axle. Further, in the arrangement of FIG. 3, inside rollers 26*b* are in a staggered relationship between those positioned on the upper axle 24*a* and the lower axle 24*b*. This staggered relationship is such that the inside rollers 26*b* on the upper axle 24*a* do not have a roller positioned vertically below them and such that the inside rollers 26*b* on the lower axle 24*b* do not have a roller positioned vertically above them. The spacing between adjacent inside rollers 26*b*, one being positioned on upper axle 24*a* and the adjacent one being positioned on the lower axle 24*b*, can be at a lateral distance 30 that is adequate for the adjacent inside rollers 26*b* to interact with a pillow 101 that extends between the adjacent inside rollers 26*b* to cause or increase pressure between the inside roller 26*b* and the surface of the pillow 101 by deforming pillow 101 as shown in FIG. 3A, which preferably causes an increase in the pressure within pillow 101 sufficient to create a pinch-point or pinch region between the inside rollers 26*b* without causing the pillow to rupture. Because burster 10 is preferably acceptable for use with a plurality of different configurations of chains 100, as stated above, distance 30 can be sufficient to create at least enough pressure to cause a level of useful friction between the pillow surface and the inside rollers 26*b* across the range of chain 100 configurations for which it is intended without causing any of the pillows 100 within the various chain 100 configurations to rupture. As shown in FIG. 3B, the inside roller 26*b* configuration of FIG. 3A is also sufficient to cause deformation of a pillow 101' that is divided into a plurality of segments 190, which causes the desired friction between pillow 101' and inside rollers 26*b*. In such an embodiment, it is preferred that the seal segments 152 do not extend all the way across pillow 101, leaving a channel 194 between pillow segments 190 that allows air to move among the pillow segments 190. In such an arrangement, if one of the pillows 190 is pinched by roller 26, the air can move through a channel 194 to the remaining pillows 101, thereby preventing rupture of the pinched pillow segment. In a further preferred embodiment, a channel is formed on each side of the seal segments 150 so that if one channel is pinched by rollers 26, if necessary, air can still travel between pillows 190 through the non-pinched channel. Preferably the two channels are spaced apart at a distance sufficient to prevent pinching of both channels simultaneously.

Figure 3C:
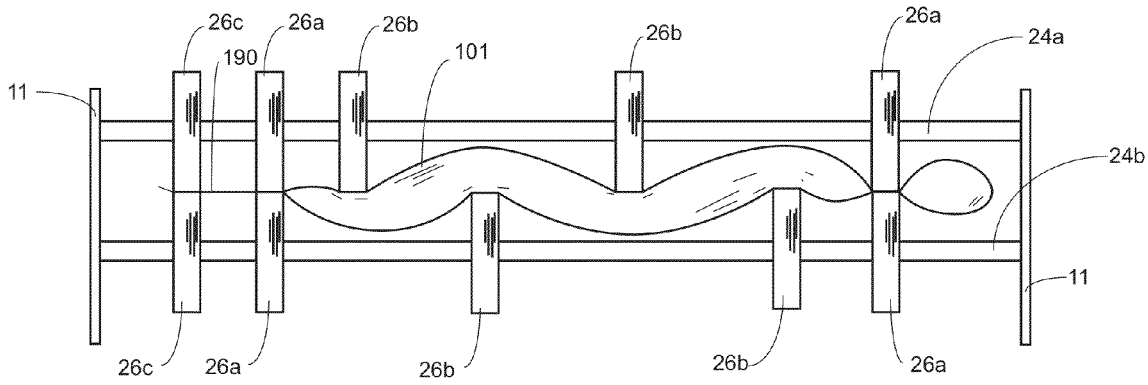

The film material used to form the chain 100 of pre-inflated pillows 101, is preferably formed having an inflation channel 198, as shown in FIG. 10, that is cut open during the inflation process to leave a flap of uninflated plastic along an edge of the chain 100. Because of the extra, uninflated plastic located along one side of the chain 100, it can be advantageous to have more rollers toward the side of the chain 100 having the inflation channel 198. This can include positioning the rollers 26 along the axles 24*a*,24*b* such that the distance between adjacent rollers is less toward the end with the inflation channel 198. Further, an additional pair of rollers 26*c* can be positioned to the outside of the outside rollers 26*a* to align with the inflation channel 198, as shown in FIG. 3C.

Figure 3D:
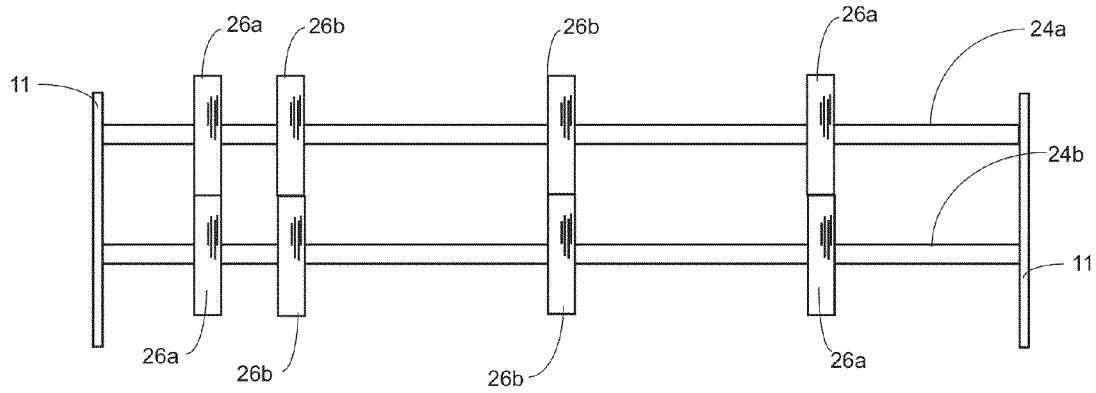

In a further alternative arrangement, shown in FIG. 3D, rollers 26 of upper axle 24*a* can be vertically aligned with a corresponding roller 26 of lower axle 24*b*. In such an arrangement, it is not necessary that the width of the chain 100 extend across all rollers.

The arrangement of rollers 26 of axles 25*a*,25*b* of the first pair of traction elements 20*a*,20*b* can be the same or different from the arrangement of rollers 26 of the second pair of traction elements 22*a*,22*b*. Any of the various roller arrangements discussed above with respect to the second pair of traction elements 22*a*,22*b* is suitable for use with the second pair of traction elements 20*a*,20*b*. The arrangements of the rollers 26 in each of the first pair of traction elements 20*a*,20*b* and second pair of traction elements 22*a*,22*b* can be selected to interact with each other to provide the desired movement and holding characteristics for device 10. The use of substantially the same roller arrangement in both the first pair of traction elements 20*a*,20*b* and the second pair of traction elements 22*a*,22*b* can provide improved holding characteristics for device 10 during the breaking operation.

Figure 4:
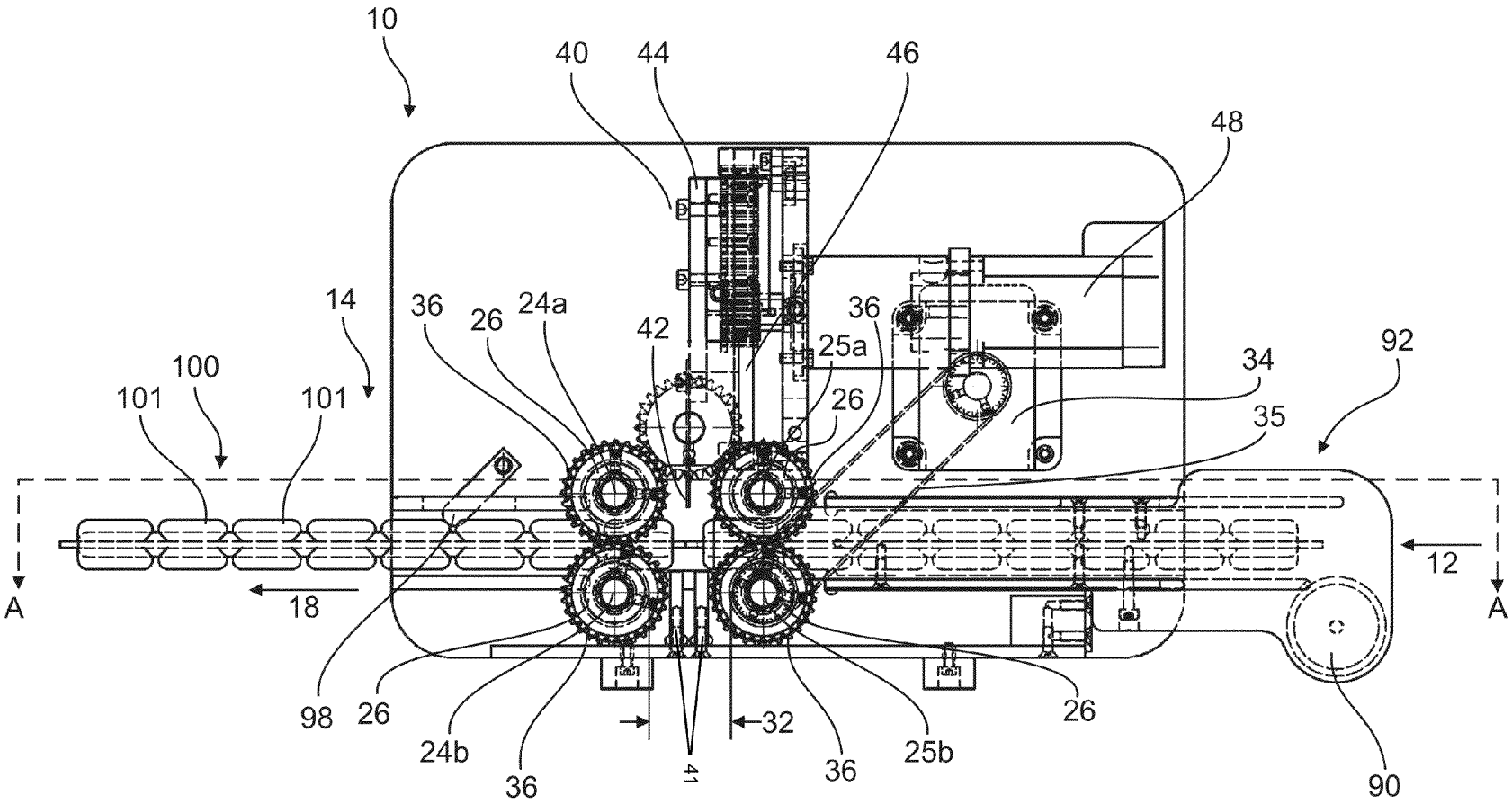
FIG. 4 is a side view of the apparatus of FIG. 2.
Figure 5:
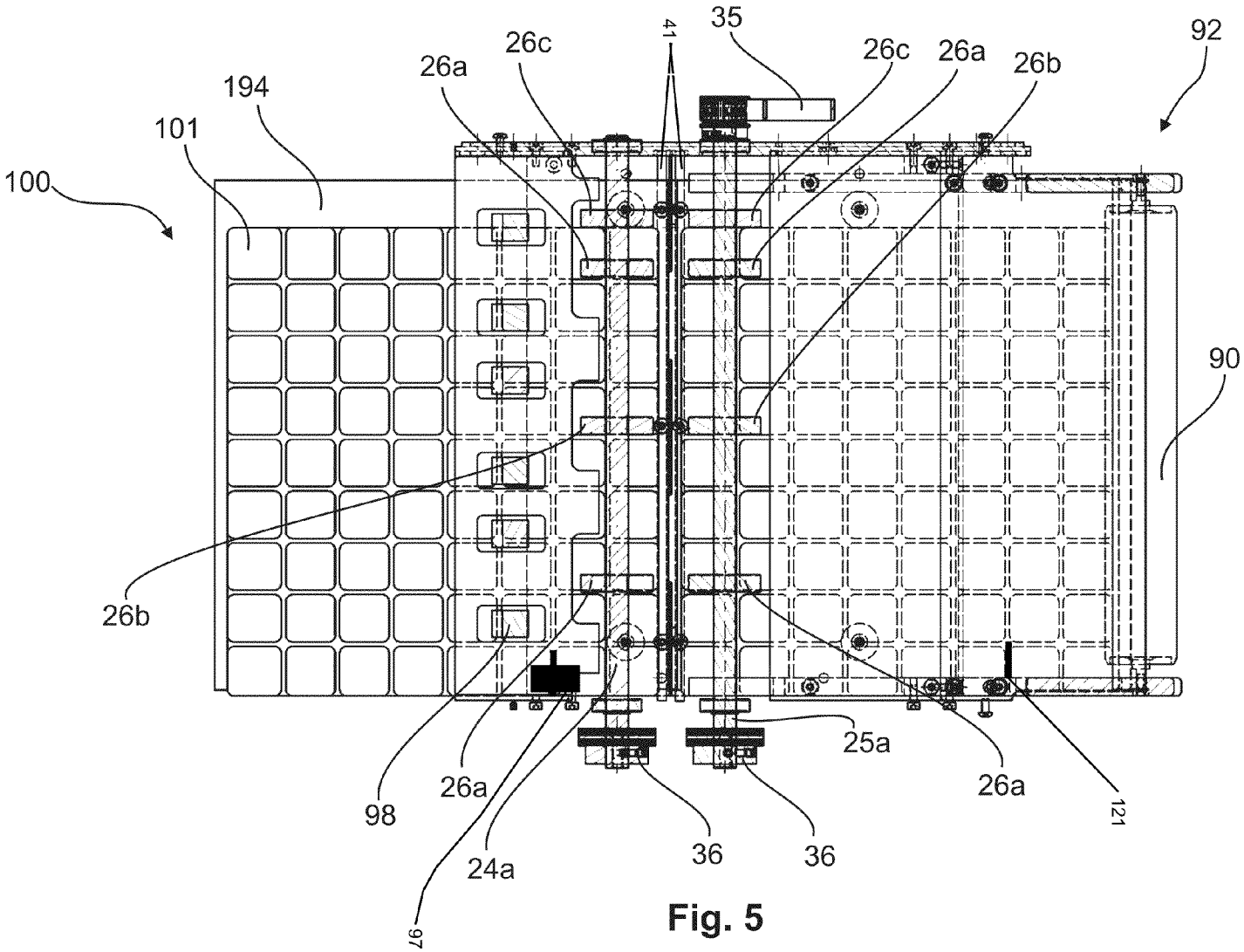
FIG. 5 is a top view of the apparatus of FIG. 2.

As shown in FIG. 4, the first and second pairs of traction elements 20*a*,20*b* and 22*a*,22*b* are spaced apart from each other in the flow direction 18 such that the a gap of a distance 32 is formed between the rollers 26 of the first pair of traction elements 20*a*,20*b* and rollers 26 of the second pair of traction elements 22*a*,22*b*. Distance 32 is preferably sufficient to provide clearance for blade 42 to fit therebetween, while providing the desired tension of chain 100 around perforation 118 during the breaking operation. Distance 32 is further preferably sufficient such that the leading end of the chain 100 (which can be created along a perforation 118 by the breaking operation) substantially aligned remains substantially aligned with the rollers of the second pair of traction elements 22*a*,22*b* as it is advanced in the flow direction 18 toward the rollers 26 to ensure proper engagement therewith.

The first and second pairs of traction elements 20*a*,20*b* and 22*a*,22*b* are preferably configured to be driven by a single motor 34 such that all of the axles 24*a*,24*b*,25*a*,25*b* move at the same speed. As shown in FIG. 4, the output of motor 34 is connected by a belt 35 to axle 25*b* to cause rotation thereof such that the top end of rollers 26 affixed thereto move in the flow direction 18. A series of gears 36 interconnect axles 24*a*,24*b*,25*a*,25*b* such that the driving motion of axle 25*b* causes synchronous movement of the remaining axles 24*a*, 24*b*,25*a* such that the rollers 26 move in the appropriate directions to cause movement of the chain 100 in the flow direction 18. Gears 36 are all the same size in order to cause all traction elements 20*a*,20*b*,22*a*,22*b* to rotate at the same speed. The interconnected arrangement of axles 24*a*,24*b*,25*a*, 25*b* is such that during the breaking operation, when blade 42 is pressed into chain 100, traction elements 20*a*,20*b*,22*a*,22*b* do not rotate, thereby holding chain 100 substantially stationary during the breaking operation.

Figure 6:
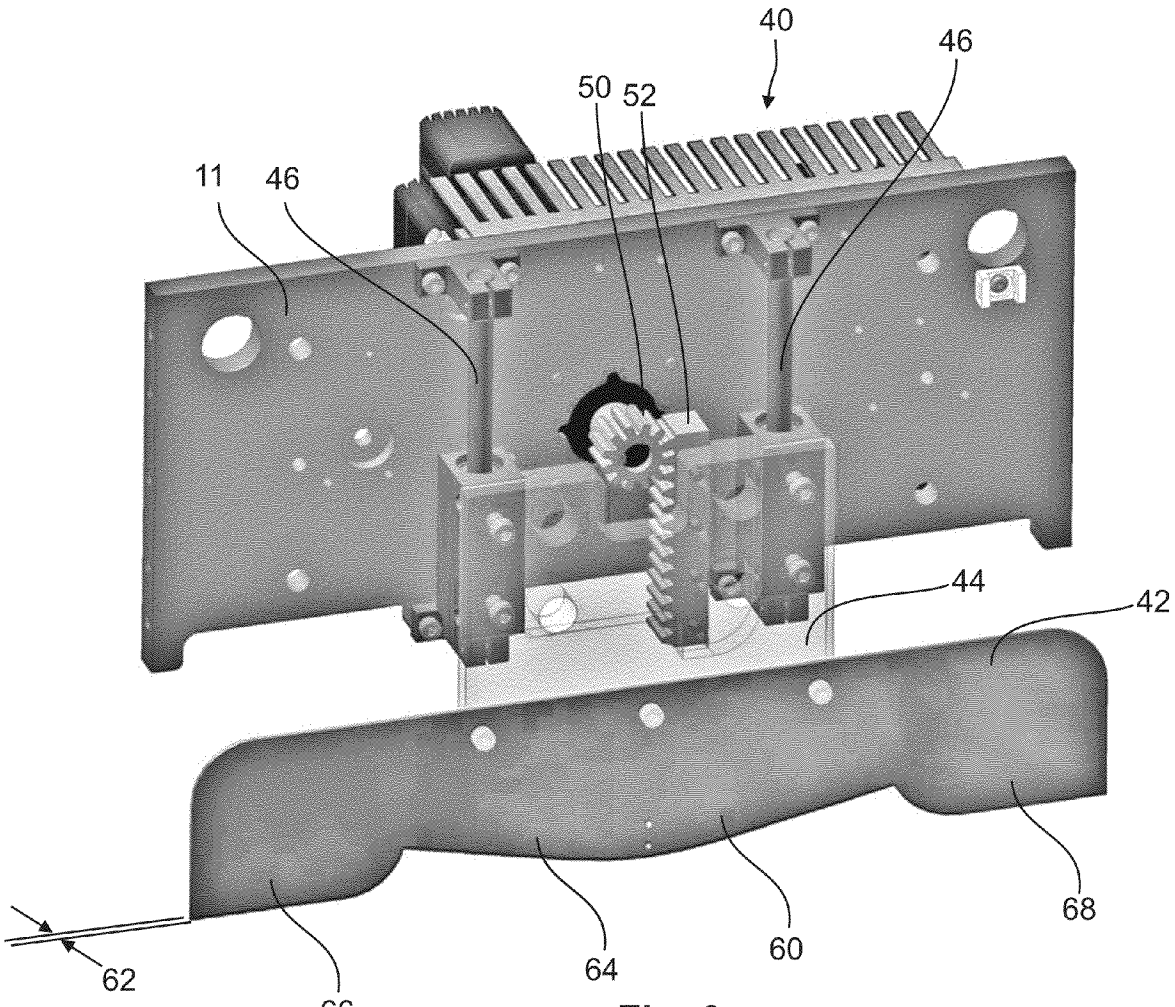
FIG. 6 is a perspective view of a breaking mechanism used in the apparatus of FIG. 2.

As stated previously, the breaking operation is carried out by breaking mechanism 40, as shown in FIG. 6, that includes blade 42 affixed to a holder 44 that travels vertically along rods 46. The vertical travel of holder 44 is controlled by motor 48. In a preferred embodiment, motor 48 is connected to holder by a rack-and-pinion system including gear 50 and rack 52 such that rotation of gear 50 in a first direction, such as the clockwise direction, causes movement of the holder 44 in the downward direction to cause blade 42 to tear chain 100 along perforation 118. Holder is retracted, or moved in the upward direction by movement of gear 50, caused by motor 48, in the reverse, or counter-clockwise, direction. Alternative arrangements for causing movement of holder 44 are possible including a cam or crank arrangement between motor 48 and holder 40 or the use of a pneumatic or hydraulic system.

Figure 7A:
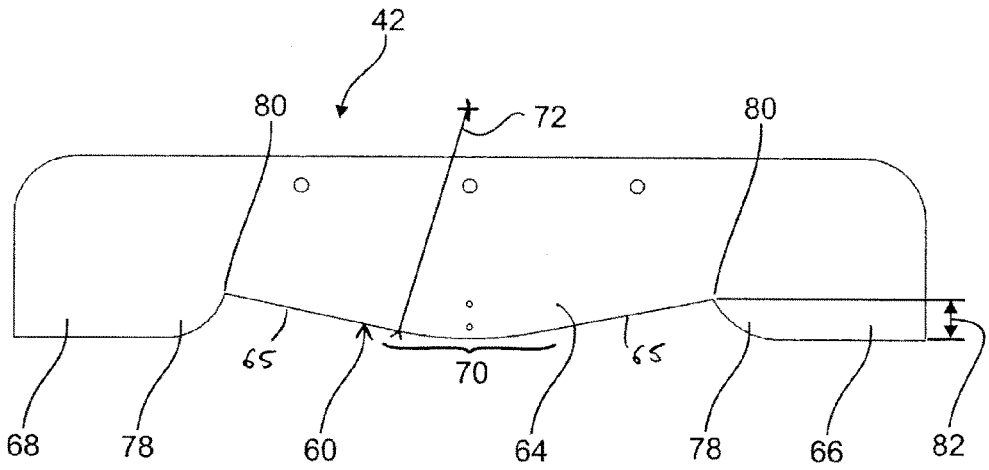
FIGS. 7A-7D are various configurations for blades that can be used in the breaking mechanism of FIG. 6.

A preferred embodiment of blade 42 is shown in FIGS. 6 and 7A, wherein blade includes a leading edge 60 along a lower portion thereof. Leading edge 60 preferably has a thickness 62 defined by the thickness of the material used to make blade 42. Preferably thickness 62 is between 0.01 in and 0.1 in. In and embodiment, thickness 62 is at least about 0.03 in. or, alternatively less than about 0.08 in. Preferably, thickness 62 is about 0.06 in., although other values for thickness 62 are possible. Blade 42 is further configured such that leading edge 60 defines a plurality of lobes on blade 42, including central lobe 64 and side lobes 66 and 68. In an embodiment, shown in FIG. 7A, central lobe 64 forms a curved portion 70 at least near the center thereof. Curved portion 70 can extend across substantially all of central lobe 64 or central lobe 64 can form straight edges 65 along the remainder thereof. Further, curved portion 70 can have a radius 72 of between about 5 in. and 7 in and more preferably about 6 in. In the embodiment of FIG. 7, side lobes 66,68 are substantially identical and include a substantially straight edge along a lower portion 76 thereof, followed by a curved portion 78 that turns upwardly to meet with central lobe 64 at an interior corner 80 curved portion 78 preferably has a radius of between about 1 in. and about 2 in and more preferably about 1.25 in. Further preferably, lobes 64,66,68 are preferably configured such that the lowermost portions of each are substantially even in a vertical direction and such that interior corners 80 are spaced above the lowermost portions of lobes 64,66,68 by a distance 82 that is between about 1 in. and 2 in. and is more preferably about 1.3 in.

In general leading edge 60 of blade 42 is configured to evenly and completely tear perforation 118 of chain 100 without deforming or otherwise damaging chain 100, including pillows 101, or without substantially altering the position of chain within burster 10. The preferred embodiment of blade 42 shown in FIG. 7A is configured as such to tension chain 100 about perforation 118 between the first and second pairs of traction members 20*a*,20*b* and 22*a*,22*b* before blade 42 begins to tear chain 100 along perforation 118. Blade 42 is further preferably configured to initiate the tearing of perforation 118 near the center thereof. This may be done simultaneously with initiating tearing of the perforation 118 near the outside ends thereof.

Figure 7B:
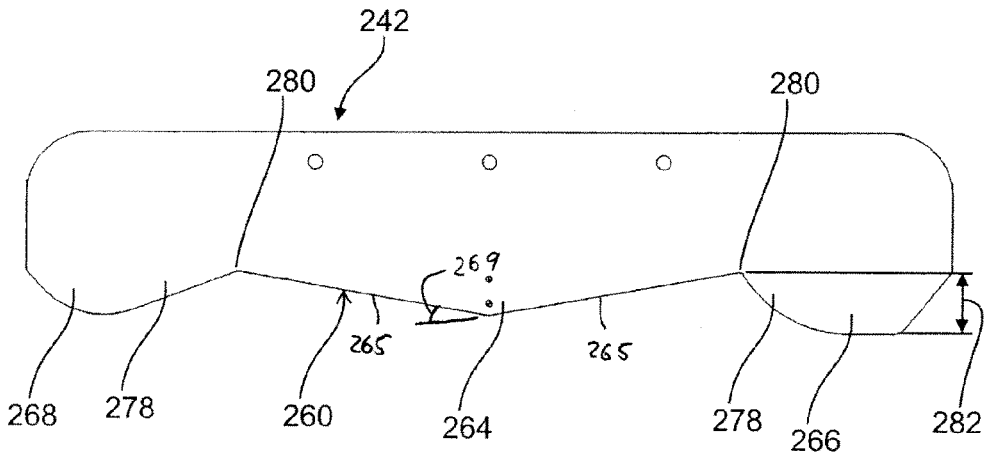
Figure 7C:
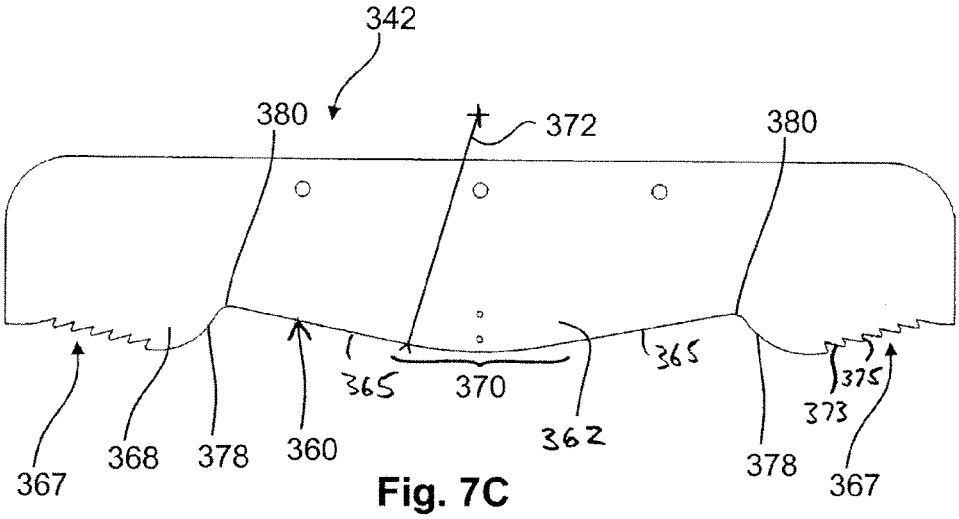
Figure 7D:
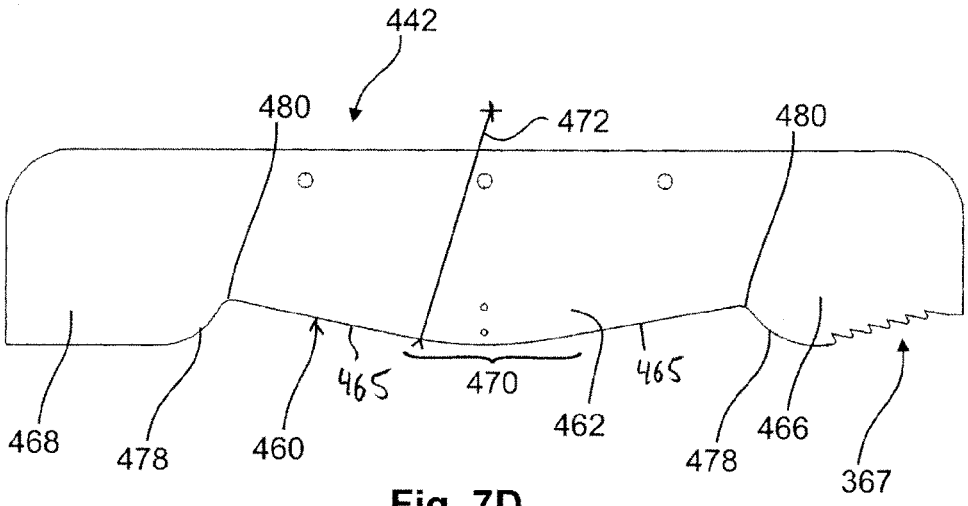
Figure 8:
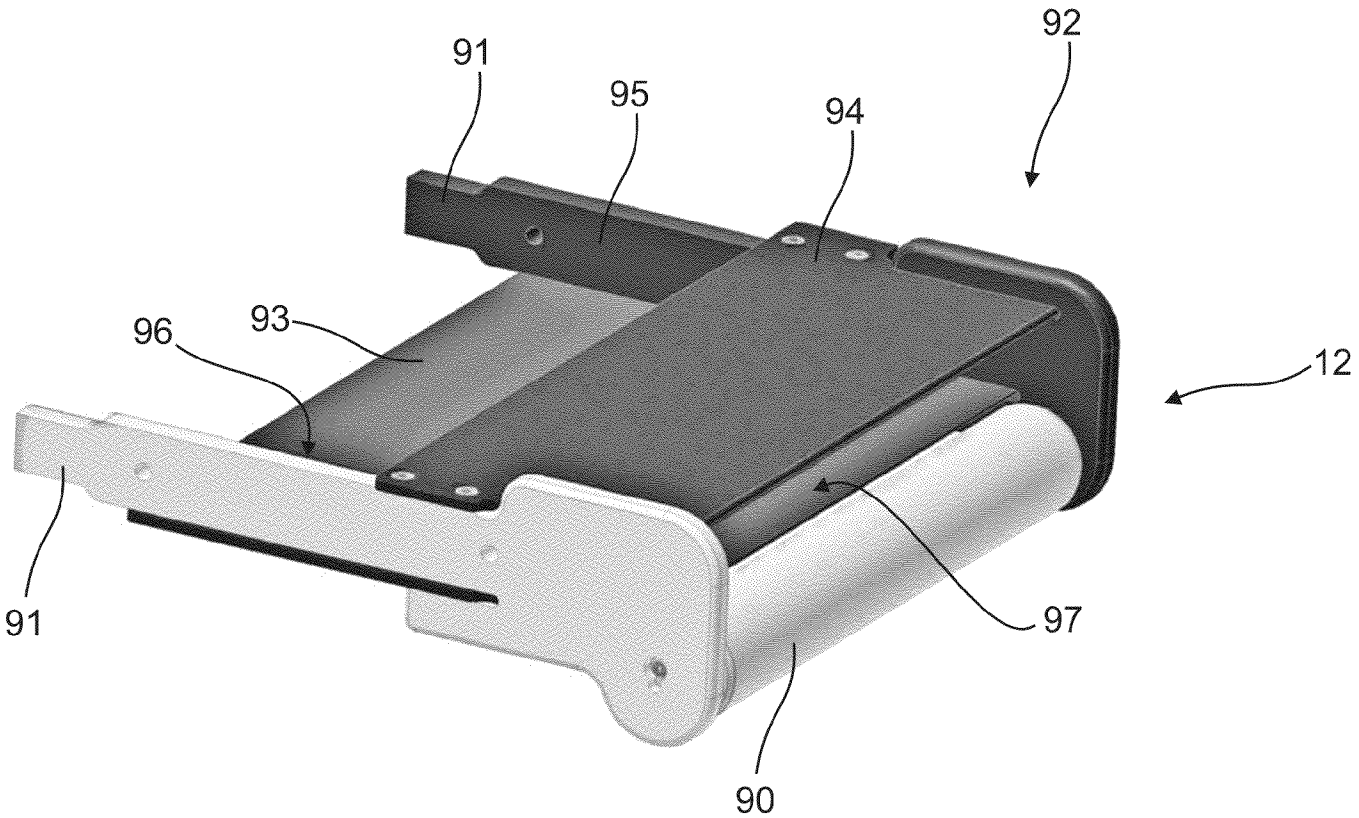
FIG. 8 is a perspective view of a removable tray used in the apparatus of FIG. 2.

Alternative configurations for blades that can be used in breaking mechanism 40 are shown in FIGS. 7B-7D. FIG. 7B shows a variation of blade 242, in which features similar to those of blade 42 are similarly numbered in the 200s, and in which outside lobes 266,268 have different shapes, lobe 266 having a rounded shape, while lobe 268 has a more pointed shape. Central lobe 264 of blade 242 also has a substantially more pointed shape compared to the arrangement of FIG. 7A, and can be formed with a pointed end, without a curved portion, by the intersection of straight edges 265. Straight edges 265 preferably form an angle 267 with a plane normal to the direction of movement of blade 242, the plane being preferably substantially parallel to the flow direction 18. In an embodiment, angle 269 is between about 5° and about 20°, and more preferably about 10°. Additionally lobes 266,268, shown in FIG. 7B include an outside edge that is substantially even in a vertical direction with interior corners 280. FIG. 7C shows a blade 342, in which features similar to those of blade 42 are similarly numbered in the 300s, and in which outside lobes 366,368 are substantially similar to each other and include a serrated edge 367 formed thereon that is angled generally upward toward the outside edges of blade 342. Serrated edge 367 includes a plurality of serrations 371, each including a leading edge 373 and a connecting edge 375 that are configured such that the connecting edge makes contact with the chain 100 during the breaking operation to form a portion of the tear along perforation 118 and such that connecting edge 375 relieves the contact of the serrated surface 367 with perforation 118 such that the serrated surface 367 makes intermittent contact with perforation 118. In an embodiment, the leading edge 373 is angled relative to a plane normal to the direction of motion of blade 42. The angle of leading edge 373 can be within the range of angles for angle 269 discussed with respect to FIG. 7B. The angle of leading edge 373 can also be substantially equal to the angle of straight portion 465. FIG. 7D shows a blade 442, in which features similar to those of blade 42 are similarly numbered in the 400s. Blade 442 has one lobe 468 with a serrated edge 467, which can be similar to serrated edge 367 discussed with respect to FIG. 7C, and another lobe 466 with a substantially straight edge 476 thereon, similar to that of lobe 66 shown in FIG. 7.

The breaking mechanism 40 can also include a pair of parallel bars 41 that are spaced beneath a plane defined by the intersection of traction elements 20*a* and 20*b* and extending in the flow direction 18 to the intersection of traction elements 22*a* and 22*b*. Bars 41 can be spaced beneath this plane at a distance sufficient to allow clearance thereover of pillows 101 as they pass through drive system 20. Bars 41 are further spaced apart along the flow direction 18 at a distance slightly greater than the thickness of blade 42. During the breaking operation, blade 42 extends into the space between bars 41 such that bars 41 can assist blade 42 during any tearing of perforation 118, at which point a portion of chain 100 surrounding perforation 118 will deform so as to contact bars 41. Such a configuration is shown in FIG. 3A, in which blade 42 is in the breaking position such that leading edge 60 thereof is positioned below the top edge 45 of bars 41, the chain 101 having been torn along perforation 118 (not shown in FIG. 3).

As shown in FIG. 4, inlet 12 of burster 10 includes a roller 90 to help guide chain 100 as burster 10 pulls chain 100 out of bin 2. Roller 90 is preferably included on a removable tray 91 that can be attached and detached from burster 10 and that included inlet 12. Tray 91 preferably includes a pair of rails 91 that are received within housing 11. Tray also preferably includes a top cover 93, a bottom cover 94 and side walls 95 and 96 that together define a guide 96 that is specifically sized for a chain configuration (or a plurality of similarly-sized chain configurations) intended for use with burster 10. Guide 97 is configured such that the vertical centerline of the chain 100 is properly aligned with rollers 26 such that chain 100 is properly engaged with the drive system 20. Guide 97 is further configured such that chain 100 is properly aligned in a lateral direction (perpendicular to flow direction 18) with rollers 26. For example, such alignment can include properly aligning inflation channel 198 with rollers 26*c*. Preferably, a number of different trays 91 are provided with burster 10 that can be interchangeably affixed with housing 11 depending on the size of the material to be used with burster 10, the configuration of tray 91 corresponding thereto accordingly.

A control system can be included in burster 10 that is configured to properly dispense a chain segment of a desired number of consecutive pillows 101 and to automatically separate the chain segment from the chain 100 by properly aligning the appropriate perforation 118 with blade 42 and for causing blade to tear chain 100 along the selected perforation 118. To achieve the proper alignment of the appropriate perforation 118 with blade 42, the control system can include an optical sensor 97 that is aligned with an edge of the chain 100 that includes a plurality of markings 121 that are spaced apart from a corresponding perforation at a distance that is substantially equal to the distance between sensor 97 and blade 42.

Accordingly, when a marking 121 is aligned with sensor 97, the corresponding perforation 118 is aligned with blade. This allows the control system to count the number of markings that pass thereunder to keep track of the number of pillows 101 being dispensed and to stop the movement of the drive mechanism 20 such that a perforation 118 is aligned with blade 42 once a chain segment having the desired number of pillows 101 has been dispensed. The control system can additionally or alternatively be configured to be controlled by a user and to receive an input therefrom by, for example, a foot pedal.

Additionally, the control system can include a sensor affixed to one of a number of fingers 98 that are affixed to a rod 99 extending across outlet 14 of burster 10. Fingers 98 are generally configured to extend downwardly across the outlet 14 when there is no portion of chain 100 present in outlet 14. Fingers 98 can, accordingly, be configured such that they can not rotate inwardly against the flow direction 18 which can add help prevent a user from accidentally reaching into outlet 14, which could cause injury. Fingers 98 are also configured to ride across the upper surface of pillows 101 as they are dispensed from outlet 14, and can further be configured to retain a chain segment within outlet 14 after the breaking operation, until a user removes the chain segment therefrom. Accordingly the sensor on one of the fingers 98 can be configured to detect the presence of a pillow within outlet 14 based on the position of the finger 98. This arrangement can be used, for example, to prevent the device from dispensing pillows 101 after a breaking operation has been performed while a pillow 101 from a previously-dispensed chain segment is still present in outlet 14 or to provide an audible or visual signal to a user indicating that the outlet 14 should be cleared. The control system can also be connected to one or more emergency switches 99 that can be configured to allow a user to stop operation of burster 10 during an emergency situation.

All of the references specifically identified in the detailed description section of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A packaging material handling device, comprising:

a first traction mechanism, including: a first axle; first traction portions rotationally disposed along the first axle on a first side of a chain region including a first opposed traction portion and a first staggered traction portion, each having a surface extending from the first axle towards the chain region to engage the chain of preinflated pillows disposed in the chain region, the first traction portions being spaced laterally from each other and define a first gap between the surfaces thereof; a second axle; second traction portions rotationally disposed along the second axle on a second side of the chain region opposite from the first side, and including:

a second opposed traction portion having a surface extending from the second axle towards the chain region opposed to the first opposed traction portion surface across the chain region and in abutment therewith to cooperatively pinch the chain between the first and second opposed traction portions, and a second staggered traction portion having a surfaced elevated towards the chain region directly opposed to the first gap across the chain region and being spaced laterally from the second opposed traction portion and defining a second gap between the surfaces thereof, such that the first and second staggered portions cooperatively deform the chain in the chain region to tension the chain without breaking the inflated pillows;

a second traction mechanism spaced longitudinally from the first traction mechanism and having traction portions disposed on opposite sides of the chain region, wherein the first and second traction mechanisms are operable for driving the chain longitudinally and holding the chain in the chain region during a breaking operation; and a breaking member disposed longitudinally between the first and second traction mechanisms and being operable to break the chain held by the first and second traction mechanisms in the breaking operation.

2. The device of claim 1, wherein the breaking member is operable in the breaking operation for moving completely through the chain.

3. The device of claim 1, wherein the first and second traction mechanisms are operable to hold first and second portions of the chain, said breaking member has a substantially blunt leading edge configured for moving against the chain for breaking a weakened area of the chain between the first and second chain portions.

4. The device of claim 3, further comprising the chain in engagement with the first and second pairs of traction mechanisms, and comprising a perforated line to provide the weakened area.

5. The device of claim 1, further including a traction member motor drivingly associated with both the first and second traction mechanisms for causing rotation of the first and second traction mechanisms together at substantially a same speed.

6. The device according to claim 1, wherein each of the first traction portions comprises rollers, the elevated surfaces being radially elevated towards the chain area, and the gaps providing radially recessed areas.

7. The device of claim 6, wherein the rollers have a surface made of an elastomeric material and disposed to engage and drive the chain.

8. The device of claim 1, further comprising first and second support bars positioned on opposite sides of the breaking member along the direction of flow and on opposite sides of the chain, and spaced apart from each other and the breaking member at a distance so as to receive the blade therebetween and sufficiently close to support the chain in the chain region to localize stresses in the chain caused by the blade to facilitate the breaking of the chain during the breaking operation.

9. The device of claim 1, wherein at least a part of the breaking member includes a serrated edge.

10. The device of claim 1, wherein the second traction mechanism includes:

third traction portions disposed on the first or second side of the chain region and including a third opposed traction portion and a third staggered traction portion each having a surface elevated towards the chain region to engage the chain of preinflated pillows disposed in the chain region, the third traction portions spaced laterally from each other and define a third gap between the surfaces thereof, the third traction portions extending toward the chain region to engage the chain in the chain region;

fourth traction portions disposed on the other of the first or second sides of the chain region, and including:

a fourth opposed traction portion having a surfaced elevated towards the chain region and being directly opposed to the third opposed traction portion across the chain region to cooperatively pinch the chain, and a fourth staggered traction portion having a surfaced elevated towards the chain region directly opposed to the third gap across the chain region and being spaced laterally from the fourth opposed traction portion and defining a fourth gap between the surfaces thereof, such that the third and fourth staggered portions cooperatively deform the chain in the chain region to tension the chain without breaking the inflated pillows.

11. The device of claim 1, wherein the first and second staggered portions are directly unopposed by traction portions that engage the chain.

12. The device of claim 1, wherein the first staggered traction portion is directly opposed to a gap between any of the second traction portions.

13. The device of claim 1, wherein the first traction portions comprise a plurality of first opposed traction portions, and the second traction portions comprise a plurality of second opposed traction portions, the elevated surfaces of the first opposed traction portions being directly opposed to the elevated surfaces of the second opposed traction portions to pinch the chain therebetween.

14. The device of claim 1, further comprising:

the first staggered portion comprises a plurality of first staggered portions that are spaced laterally from each other to define a plurality of first gaps therebetween; and the second staggered portion comprises a plurality of second staggered portions that extend toward the chain region directly opposed to the plurality of first gaps across the chain region, and are spaced laterally from each other to define a plurality of second gaps therebetween;

wherein the plurality of first staggered portions are directly opposed to the plurality of second gaps across the chain region such that the first and second staggered portions cooperatively deform the chain in the chain region to tension the chain without breaking the inflated pillows.

15. The device of claim 14, wherein the first axle has an axis of rotation on which the traction portions are affixed.

16. The device of claim 15, wherein the second axle has an axis of rotation on which the traction portions are affixed.

17. The device of claim 1, wherein the first gap has a transverse width that is sufficiently wider than the transverse width of the second staggered traction portion, such that the second staggered portion entirely faces the first gap across the chain region.

18. The device of claim 1, wherein:

the first opposed traction portions include a plurality of first opposed traction portions;

the second opposed traction portions include a plurality of second opposed traction portions, each second opposed traction portion being directly opposed the first opposed traction portion; and the staggered traction portions are disposed laterally between opposed pairs of the first and second opposed traction portions.

19. A packaging material handling device, comprising:

a first pair of traction members configured for cooperatively engaging a chain of pre-inflated pillows from opposite sides thereof and being operable for driving the chain longitudinally in a flow direction;

a second pair of traction members configured for cooperatively engaging the chain from opposite sides thereof, the second pair being longitudinally spaced apart from the first pair of traction members and being operable for driving the chain longitudinally in the flow direction, wherein the first and second pairs are operable for holding first and second portions of the chain during a breaking operation; and a blade including a substantially blunt leading edge disposed between the first and second pairs of traction members and being movable against the chain across the flow direction in the breaking operation to break the chain for detaching the first portion from the second portion, wherein the leading edge comprises a central lobe and a pair of outer lobes, the central lobe being disposed laterally across the flow direction between the pair of outer lobes, and recessed areas being disposed laterally between the central lobe and the outer lobes, with a sloped surface extending laterally from the central lobe into the recessed areas.

20. The device of claim 19, wherein the lobes contact the weakened area of the chain before the recessed area and the sloped surface gradually breaks the weakened area of the chain as the blade moves therethrough during the breaking operation.

21. The device of claim 20, wherein the recessed areas define a substantially sharp, concave portion between the sloped surface and the outer lobes.

22. The device of claim 20, wherein the lobes are rounded when viewed along the direction of flow.

23. The device of claim 20, wherein the central lobe is disposed at the lateral center of the blade.

24. The device of claim 19, further comprising first and second support bars positioned on opposite sides of the blade along the direction of flow and on opposite sides of the chain, and spaced apart from each other and the blade at a distance so as to receive the blade therebetween and sufficiently close to support the first and second portions of the chain to localize stresses in the chain caused by the blade to facilitate the breaking of the chain during the breaking operation.

* * * * *